US005414902A

United States Patent [19]

Kroyer

[11] Patent Number: 5,414,902

[45] Date of Patent: May 16, 1995

[54] DEFIBRATOR WITH RIBS, BEATER PLATE, GRATE AND BEATER BARS

[76] Inventor: Karl K. K. Kroyer, Le Vieux Moulin, 12, rue de la Libération, F-06520 Magagnosc, France

[21] Appl. No.: 141,936

[22] Filed: Oct. 28, 1993

[51] Int. Cl.[6] ..... D01G 25/00; B07B 1/20; D21F 1/48

[52] U.S. Cl. ..... 19/305; 28/165; 209/393; 241/190; 264/116; 425/83.1

[58] Field of Search ..... 26/22, 25; 28/167, 168; 241/51, 73, 74, 79.2, 87, 88, 88.4, 190; 162/352, 351, 301, 219; 19/104, 106 R, 109, 110, 95, 97, 62 R, 304, 305, 306; 209/393, 395, 320, 388

[56] References Cited

U.S. PATENT DOCUMENTS

| | | | |
|---|---|---|---|
| 1,749,954 | 3/1930 | Luebbers | 241/190 |
| 2,421,478 | 6/1947 | Blewett | 19/95 X |
| 2,432,235 | 12/1947 | Grimes | 19/95 |
| 2,635,298 | 4/1953 | Lepkowski | 19/95 |
| 2,809,400 | 10/1957 | Malenfort | 19/95 X |
| 3,984,898 | 10/1976 | Matsumura et al. | 425/82.1 X |
| 4,030,865 | 6/1977 | Kobayashi | 425/83.1 X |
| 4,264,289 | 9/1981 | Day | 425/83.1 |
| 4,410,424 | 10/1983 | Chupka et al. | 209/393 X |
| 5,089,090 | 2/1992 | Hansen | 162/352 X |
| 5,215,628 | 1/1993 | Koivuranta et al. | 162/352 X |
| 5,316,601 | 5/1994 | Hebbard et al. | 425/82.1 X |

FOREIGN PATENT DOCUMENTS

| | | | |
|---|---|---|---|
| 0103014 | 1/1917 | United Kingdom | 19/95 |

*Primary Examiner*—Clifford D. Crowder
*Assistant Examiner*—Israel Izaguirre
*Attorney, Agent, or Firm*—Watson, Cole, Grindle & Watson

[57] ABSTRACT

A defibrator which makes it possible to distribute defibrated cellulosic fibers directly onto a forming wire (5) includes ribs (33) extending inside a cylindrical housing (24). The ribs have outer curved surfaces which direct fibers into an area (35) in which beater plates (25). A grate (37) in front of an outlet (30) from the circular housing (24) is arranged at the periphery (35) for the rotation of the beater plates (25). The grate has an interspace between grate bars only allowing fibers to pass through. Accordingly, agglomerates are returned into the working area of the beater plates (25). As the beater plates (25) act several times on agglomerates, it is ensured that only individual fibers pass through the grate (37). Accordingly, fibers are discharged directly onto the forming wire (5) from a discharge opening (2) of the defibrator (1). Preferably, the discharge opening (2) has a width corresponding to the width of the product to be formed on the forming wire (5).

12 Claims, 4 Drawing Sheets

DEFIBRATOR WITH RIBS, BEATER PLATE, GRATE AND BEATER BARS

BACKGROUND AND SUMMARY OF THE INVENTION

This invention concerns a defibrator for manufacturing a fibrous product preferably of cellulosic fibers by separating a sheet of raw material by means of rotating beater bars provided in a cylindrical housing and cooperating with a stationary beater plate provided adjacent an inlet opening through which the sheet of raw material is introduced into the cylindrical housing, wherein the axis of rotation of the beater bars is off-set in relation to the central axis of the cylindrical housing.

The fibers to be used in the present invention comprise cellulosic fibers, wood fibers, mixtures with synthetic fibers including bicomponent fibers and synthetic fibers. The synthetic fibers may, e.g., be of polypropylene or polyethylene. Also glass fibers, rock wool fibers, and pretreated fibers may be used.

The defibrator according to the present invention makes it possible to effect a good defibration, and accordingly, there is no need to use a distributor. The defibrated fibers may be deposited directly from a discharge opening of the defibrator.

When dry forming a paper it is customary to connect a defibrator used for defibrating the sheets of raw material with a specific distributor. The distributor makes it possible to distribute the fibers. Besides, a distributor makes it possible to catch any agglomerations of fibers which may detoriate the fibrous web formed. With the art it is well-known that such agglomerations of fibers are always found in the discharge from prior art defibrators.

Provided that the defibrator may effect a defibration so that no agglomerates of fibers or substantially no agglomerates occur in the discharge from the defibrator. A distributor will not be necessary for a great number of products It is an object of the present invention to provide a defibrator having improved defibration.

It is a further object of the invention to provide a defibrator making it possible to discharge fibers directly onto a forming wire, thereby obviating the need of using a distributor at least when making products wherein it is accepted to have agglomerates comprising a few, e.g., 2–5, interconnected cellulosic fibers.

It is a further object of the invention to provide a defibrator having a discharge opening with a length corresponding to the width of the product to be formed on the forming wire.

According to the present invention the above objects are obtained with a defibrator wherein the axis of rotation of the beater bars is off-set in relation to the central axis of the cylindrical housing, wherein the inner surface of the cylindrical housing of the defibrator is provided with ribs having a surface facing against the axis of rotation with a curvature for directing the fibers into the working area of the beater bars, the ribs are arranged adjacent the inlet opening in direction of rotation for the beater bars, and wherein the outlet opening is covered with a grate formed by parallel grate bars, each grate bar extends in a plane perpendicular to the axis of rotation and has a curved surface arranged in a distance from the axis of rotation corresponding to the distance between the axis of rotation and the outer edge of the beater bars, thereby making it possible to clean the grate by means of the rotating beater bars.

The action of the beater bars is not a cutting. The beater bars effect rather a breaking of the raw material in order to separate it into individual fibers. In order to obtain a secure separation into individual fibers the beater bars should act on the fibers or agglomerations of fibers as many times as possible. This is achieved in the defibrator as the surfaces of the ribs direct agglomerates of fibers into the working area of the beater bars.

The use of ribs having curved surfaces makes it possible to direct fibers into the working area of the rotating beater bars. Due to the higher mass of an agglomeration of fibers such agglomeration will be directed or thrown into the working area of the beater bars with a greater force than the single fibers. Accordingly, it is possible for the beater bars to act on the fibers, several times, whereby a very secure defibration of the fibers is obtained.

An agglomeration of fibers which is retained by the grate will also be thrown into the working area of beater bars when the outer edge of the beater bars pass the grate. Thus, such agglomeration will be subjected to further action from the beater bars, whereby a better defibration is obtained.

It is preferred that the grate bars taper in the direction of the flow in order to hinder the fibers in being caught in the interspace between adjacent grate bars.

Inside the cylindrical housing a banana-shaped area is provided due to the excentricity. In this area the beater bars are not active. The fibers provided in this area will be single fibers. Even though it might be advantageous to have the outlet opening arranged in this part of the cylindrical wall, it is preferred to have the outlet opening arranged in an area in which the beater bars operate. Thereby it is possible to use the beater bars as cleaning members for the grate arranged in the outlet opening.

Moreover, it is preferred to arrange a suction fan in the outlet of the defibrator in a position between the outlet opening and the discharge opening. Such suction fan will ensure a more even distribution of fibers. However, it might also be possible to provide the distributor without a suction fan. In this case an air flow is provided by a suction box arranged at the opposite side of a forming wire.

According to a preferred embodiment the sheet of raw material is introduced substantially horizontal in a 3 o'clock position and the beater bars are rotated counter clockwise. In such defibrator the outlet opening is arranged in a 6 o'clock position. This ensures that the fibers pass through at least 270° whereby the beater bars might act several times on each fiber.

Further features and advantages of the present invention will be understood by reference to the attached drawings taken in conjunction with the ensuing discussion.

DESCRIPTION OF THE PREFERRED EMBODIMENTS

Figure 1:
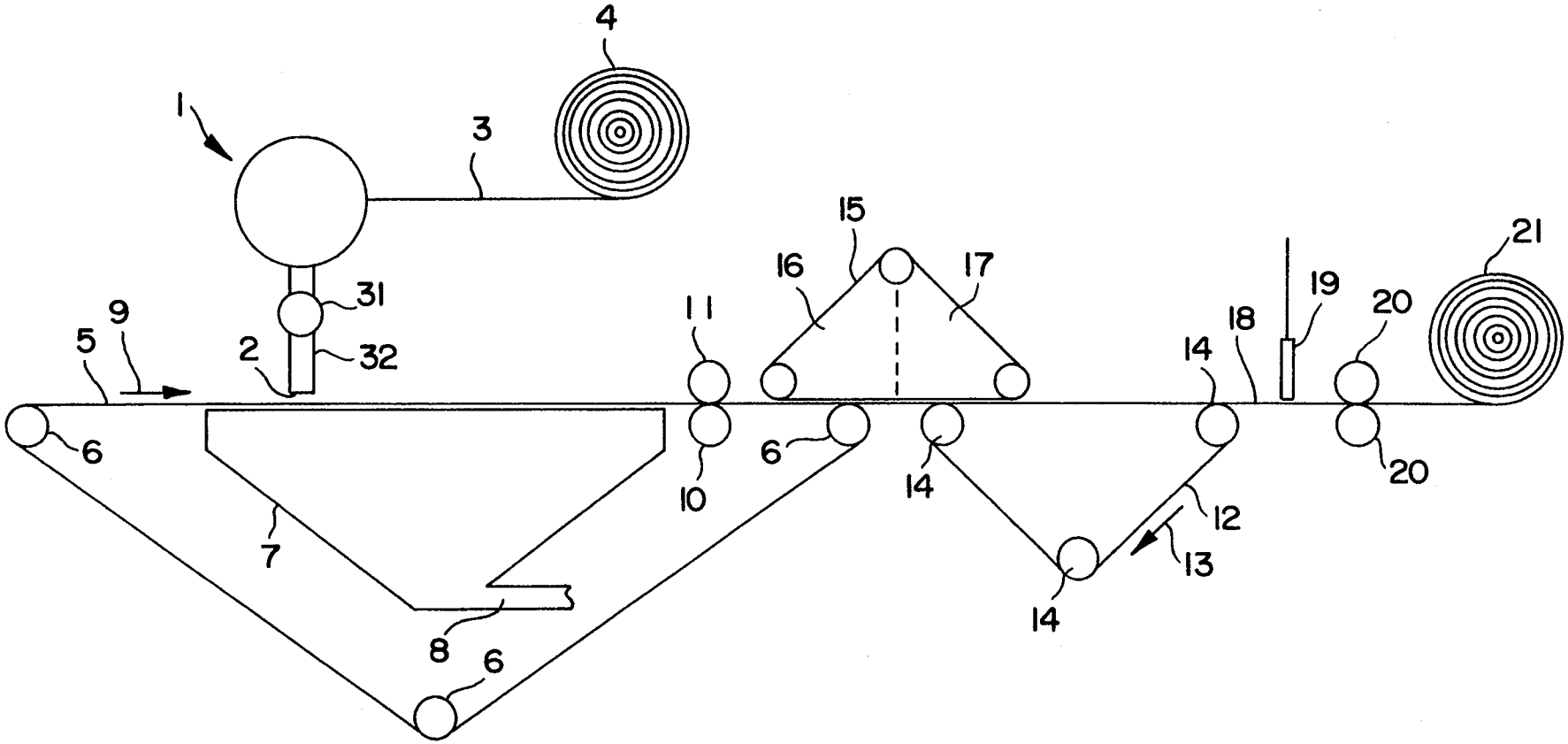
FIG. 1 illustrates diagrammatically an embodiment of an apparatus incorporating a defibrator according to the present invention.

The apparatus shown in FIG. 1 comprises a defibrator 1 according to the invention. The defibrator has a downwardly oriented discharge opening 2 for discharge of defibrated fibers. Alternatively, the defibrator 1 may be arranged in a separate room and be connected with a distributor in a manner which is well known to a skilled person. The defibrator is fed with a sheet 3 of dry woodpulp from a reel 4. The raw material may also be provided in plates. The raw material will preferably be provided with a thickness of approximately 5 mm. It is also possible to use baled pulp or shredder pulp as a raw material. The upper run of an endless perforated forming wire 5, mounted for rotation on two rollers 6, is located directly below the discharge opening 2. At the opposite side of the forming wire 5 a suction box 7 is arranged which is connected with a suction pipe 8 for creating a vacuum therein. The forming wire 5 is passed through the area between the lower edge of the discharge opening 2 and the upper edge of the suction box 7 according to a travelling direction indicated with an arrow 9. The apparatus also comprises a set of nip rollers 10,11. Thereby a comprimation of the dry laid fibers is effected.

An endless band 12 is arranged in continuation of the forming wire 5. The band 12 is driven in direction of an arrow 13 around three rollers 14. A further endless band 15 is provided above the forming wire 5 and the band 12. The interior of the endless band 15 is divided into two compartments 16,17 having a vacuum and an overpressure, respectively. This arrangement is intended for transferring the fibrous web 18 from the forming wire 5 to the endless band 12. Spraying nozzles 19 is arranged in order to apply a binder solution to the web 18. The nozzles 19 are only illustrated at one side. However, it is preferred that the web 18 is sprayed from both sides. The apparatus also comprises a set of embossing rollers 20 and a roller 21 for reeling up the web 18. The rollers 20 may be heated in order to obtain a curing of the binder applied. It is also possible to use a separate curing unit arranged after the embossing rollers 20.

In FIG. 1 only one defibrator is illustrated. However, it is also possible to use two or more defibrators arranged successively along the forming wire 5. Each of the defibrators 1 should cooperate with its own suction box 7. Moreover, each defibrator 1 should be connected with its own reel 4 of raw material. In this case the apparatus comprising defibrators according to the invention may be used for manufacturing layered products in which each layer has different properties.

Figure 2:
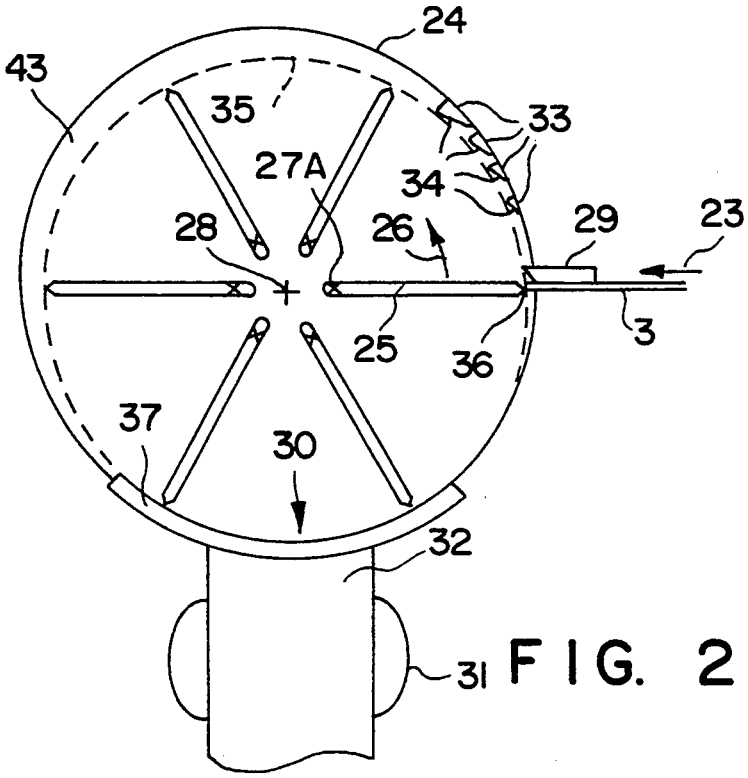
FIG. 2 illustrates a diagrammatically enlarged sectional view through a defibrator illustrated in FIG. 1, FIG. 3 a diagrammatically and enlarged sectional view illustrating the ribs provided in the defibrator illustrated in FIG. 2, FIG. 4 a fragmentary enlarged sectional view illustrating the grate bars arranged in the defibrator illustrated in FIG. 2, and FIGS. 5 and 6 illustrate diagrammatically a further embodiment of an apparatus incorporating a defibrator according to the present invention.

FIG. 2 illustrates diagrammatically a preferred embodiment for the defibrator 1 according to the invention. The defibrator 1 comprises an inlet opening 22 for the raw material 3 which is advanced according to the arrow 23. The defibrator has a cylindrical housing 24 in which a series of rotating beater bars 25 is arranged. Only one beater bar is illustrated. However, the beater bars 25 are arranged side by side through the defibrator in rows, preferably in a number of 6, essentially parallel with an axis of rotation 27. Each beater bar is arranged for a swinging movement around axes 27A. Alternatively, the beater bars 25 may be arranged so that each following beater bar is off-set. Hereby the beater bars form spirals through the cylindrical housing 24. The beater bars 25 are rotated according to the direction indicated by an arrow 26, viz. in a counter clockwise direction. The beater bars rotate around the axis of rotation 27. The axis 27 is arranged excentrically in the cylindrical housing 24 which has a central axis 28. Thereby the beater bars have an action area defined by a circle 35. This creates a banana-shaped area 43 in which no action occurs from the beater bars.

The beater bars 25 of the defibrator cooperate with a fixed beater plate 29 arranged at the upper side of the inlet opening 22. The raw material is separated into single fibers which are drawn from the cylindrical housing 24 through an outlet opening 30. A suction fan 31 is provided in the outlet pipe 32 in position between the discharge opening 2 and the outlet opening 30 in the wall of the cylindrical housing 24.

It is possible to rotate the beater bars 25 in the opposite direction by providing the fixed beater plate 29 at the lower side of the inlet opening 22. However, in this situation the outlet opening 30 from the cylindrical housing is arranged at the top so that the fibers should pass through at least 270° from the inlet opening 22 to the outlet opening 30.

At the inner wall of the cylindrical housing 24 ribs 33 are provided. The number of ribs may be adjusted according to the quality of the product to be formed. Thus, by reducing the number of ribs 25, e.g., when producing core material, it is possible to reduce the energy consumption. The ribs 33 may extend parallel to the central axis 28 of the housing. Alternatively, the ribs 33 may extend helically around the central axis 28. The surface 34 of the ribs 33 facing against the axis of rotation 27 has a curved surface. The curvature of the surface 34 of the ribs directs fibers into the working area of the beater bars. This working area is defined by the outer circle 35 described by the tip 36 of the beater bars 25.

Figure 3:
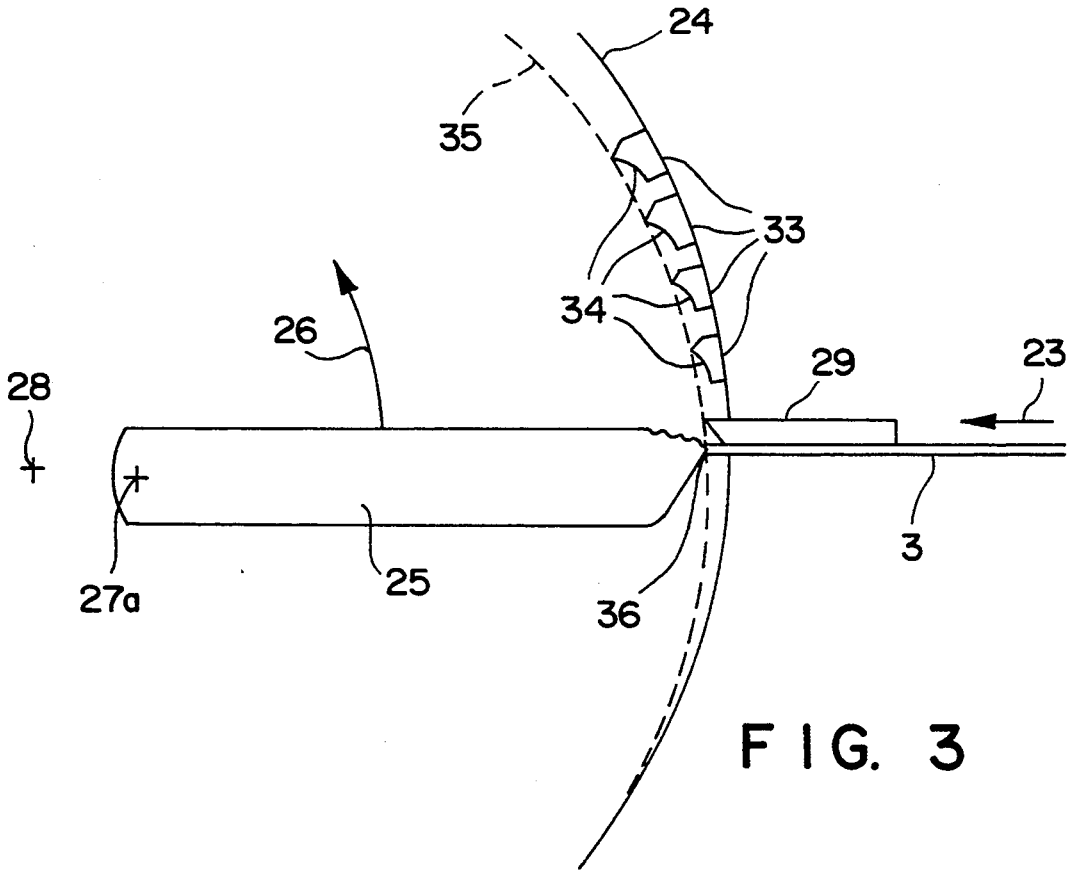

Due to the curved surface 34, fibers or agglomerations of fibers are directed or thrown into the area defined by the circle 35, see also FIG. 3. Accordingly, the fibers are subjected to the action of the beater bars very often which is advantages as any agglomerates thereby is separated.

Figure 4:
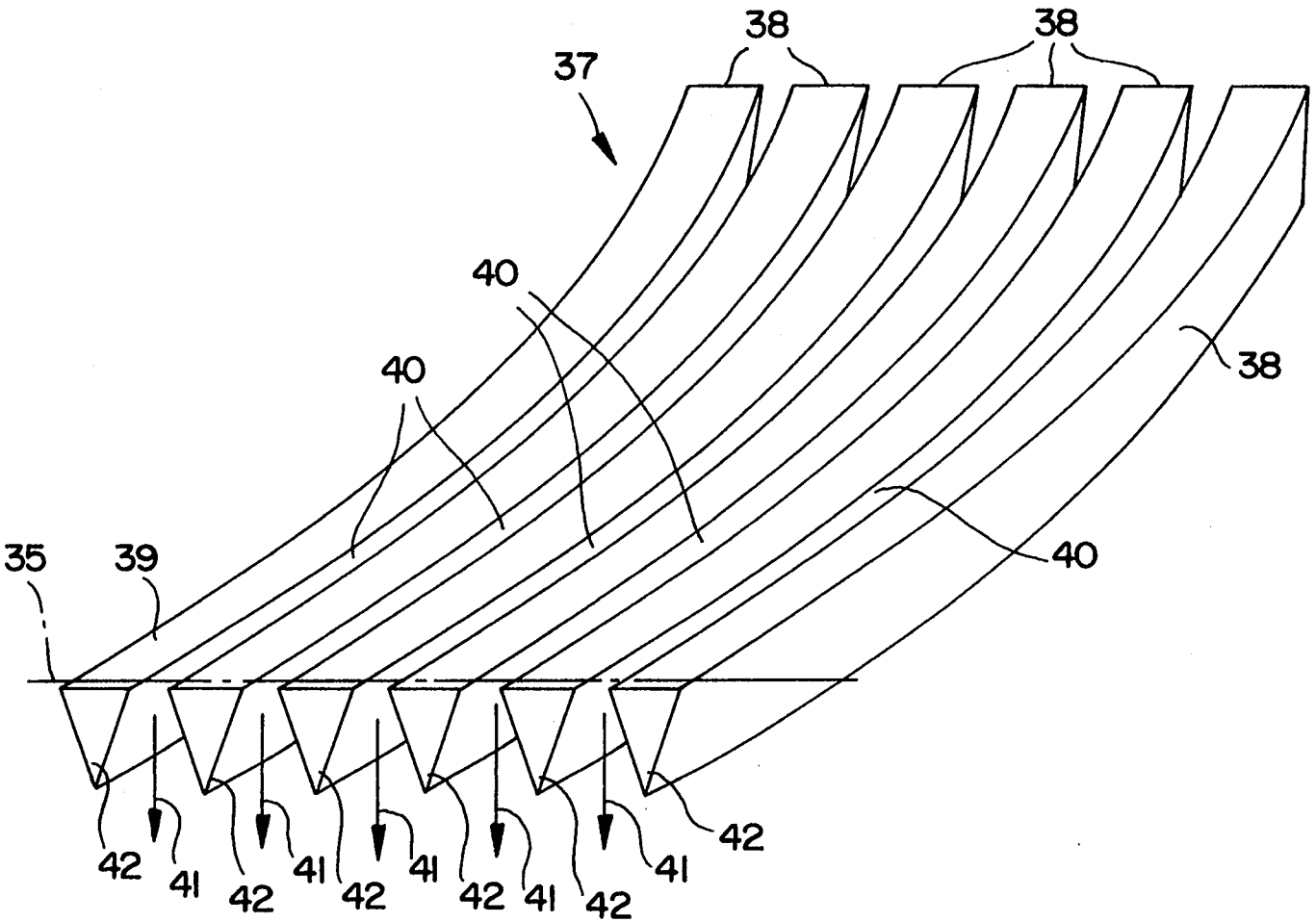

In FIG. 4 a partial cross-section through a grate 37 is illustrated. The grate 37 consists of grate bars 38 having a triangular cross-section. The grate 37 is intended to be positioned in the outlet opening 30 from the cylindrical housing 24. The grate is arranged with a plane surface 39 facing against the interior of the cylindrical housing 24. The grate bars are curved and the plane surfaces 39 are arranged at a circumference defined by the circle 35. Thereby the tips 36 of the beater bars 25 will clean the grate for any agglomerate which does not pass through the interspace between adjacent grate bars. These agglomerations are directed into the working area and will be subjected to further actions from the beater bars 25.

The interspace 40 between adjacent bars 39 is between 1½ and 2 mm. Thereby single fibers may pass through the interspace whereas agglomerates are retained. The width of a bar is between 1½and 2 mm and the thickness is between 8 and 12 mm. The length is between 80 and 120 mm. Thus the bars 33 extend across the outlet opening 30 which has a width between 7 and 8 mm. Due to the length of the bars 33 a secure drawing fibers out from the defibrator 1 is obtained.

Due to the triangular shape with the tapering end 42 arranged in the direction of the flow 41 of fibers, there will be no risk that the fibers are retained in the grate. Thereby also the risk of formation of agglomerations is eliminated.

Due to the form of the grate bars 38 and the form of the ribs 33 the defibrator may have its discharge opening 2 provided directly as a discharge opening for depositing directly onto the forming wire. The length of the discharge opening corresponds to the length of the defibrator. This could have a length between 250 mm and 500 mm. The diameter of the defibrator 1 is between 600 and 800 mm. The length of each beater bars 25 is between 180 and 350 mm, preferably between 180 and 200 mm. The width of a beater bar 25 is between 3 and 8 mm, preferably 5 mm. However, it is preferred that the length of the defibrator corresponds to the width of the product to be formed. Thus it is possible to use the defibrator for directly forming a product with its intended width.

It is possible to use several successively arranged defibrators 1, thereby making it possible to provide a product having layers with different properties. It might, e.g., be possible to provide two outer layers comprising hydrophobic fibers and an intermediate layer comprising hydrophobic fibers. Such product would be suitable as a diaper or a sanitary napkin. A content of few agglomerations, e.g., 2–5 agglomerated fibers, is acceptable in such products.

The sheet of raw material could be provided in endless lengths or in the form of plates. However, it should be ensured that the raw materials are supplied continously as the defibrator should work continously with a capacity adapted to the speed of the forming wire 5 upon which the web 18 is formed.

Figure 5:
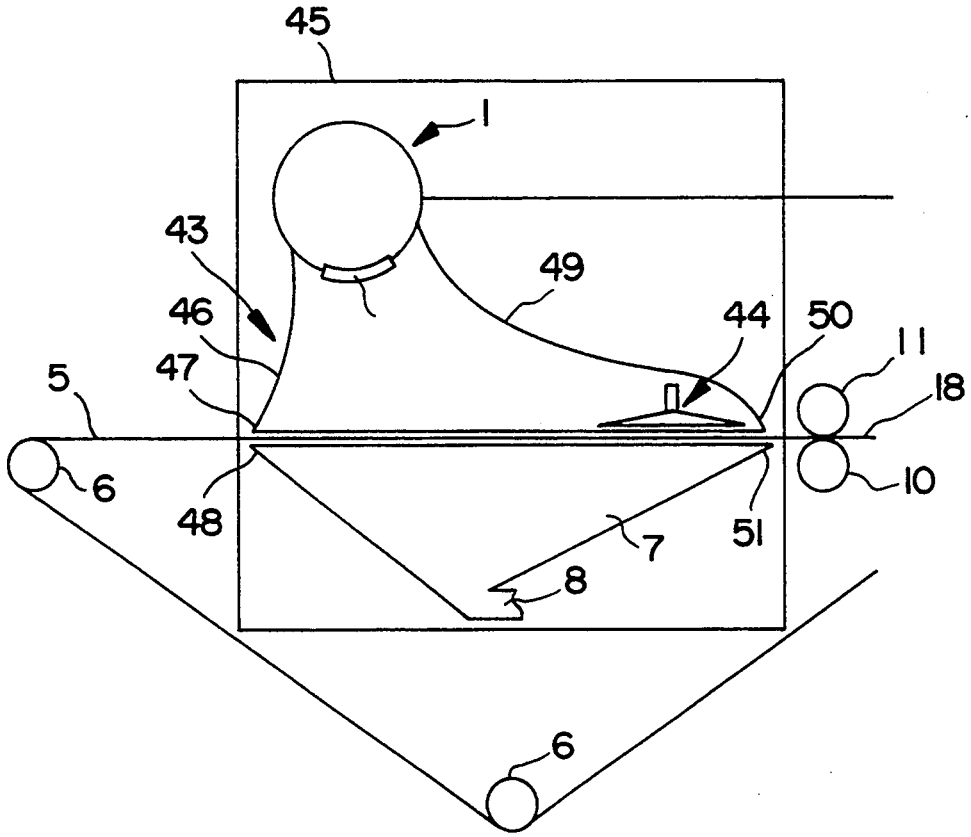

FIG. 5 illustrates a fragmentary view of a further embodiment of an apparatus incorporating a defibrator 1 according to the present invention. FIG. 5 corresponds substantially to FIG. 1, and accordingly, identical parts are designated with identical reference numbers and will not be explained in detail.

Figure 6:
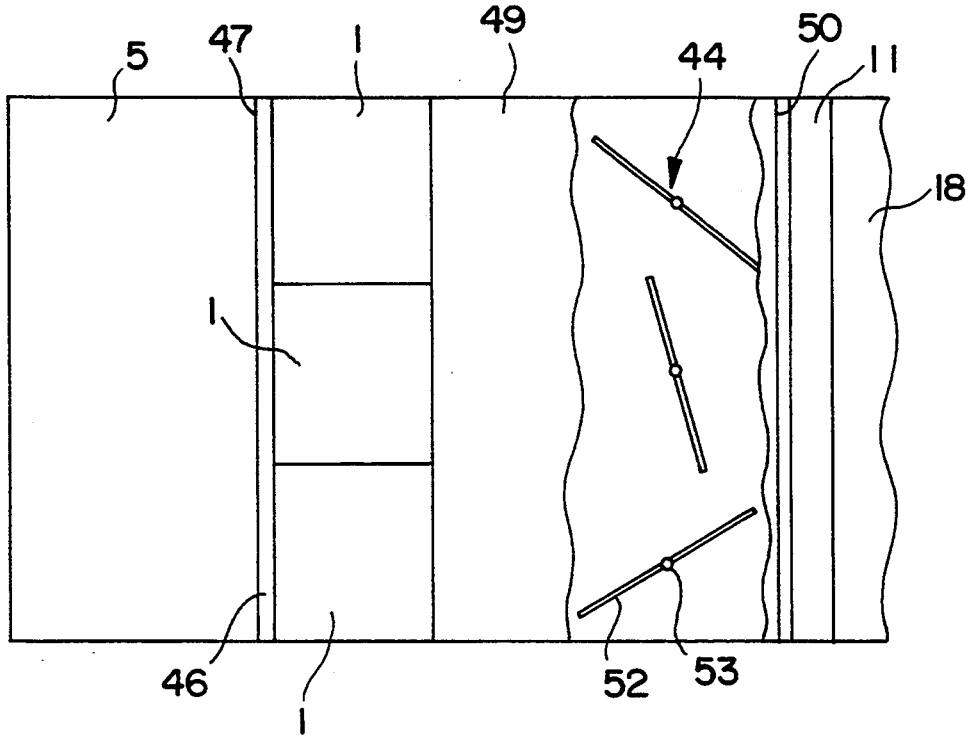

FIG. 6 illustrates the apparatus of FIG. 5 with some parts broken away and as seen from above.

The defibrator 1 having an outlet opening 30 is connected with a funnel 43, which comprises stirring means 44 and which are to be explained later. The defibrator 1, the funnel 43 and the suction box 7 are arranged within a closed housing 45. The housing 45 will reduce problems with noice from the defibrator 1 and problems with dust originating from the fibers. Thus the suction pipe 8 will be connected with the air-inlet for the defibrator. In this way the web 18 formed would act as a filter to reduce the amount of dust.

The funnel 43 comprises a first wall 46 ending in a gasket 47 to be in contact with the forming wire 5 at a first corner 48 of the suction box 7. The funnel 43 comprises a second wall 49 having a second gasket 50 which e.g. might be provided in the form of a roller and which is in contact with the layer of fibers deposited on the forming wire 5. The gasket 50 is provided at a second corner 51 of the suction box 7.

In FIG. 6 a part of the second wall 49 is broken away in order to illustrate the stirring means 44. Each of the stirring means comprises a wing 52 arranged immediately above the forming wire 5 and a drive shaft 53 arranged for rotating the wing 52. Each of the drive shafts 53 is connected with mutual drive means (not shown). The stirring means 44 would have a function which is comparable with stirrers of prior art distributors e.g. as disclosed in U.S. Pat. No. 4,494,278. However, the combined unit disclosed herein consisting of the defibrator 1, the funnel 43 containing the stirring means would have a more compact structure and could be provided within the closed house 45. Accordingly, it would be possible to provide a very compact unit.

I claim:

1. A defibrator for manufacturing a fibrous product which comprises:

a cylindrical housing which defines an inlet opening, an outlet opening, an inner surface, and a central axis, a plurality of ribs located on said inner surface of said cylindrical housing adjacent said inlet opening, said plurality of ribs each providing a curved surface facing inwardly of said cylindrical housing, a grate positioned across said outlet opening of said cylindrical housing, said grate being formed of parallel grate bars providing curved surfaces which face inwardly of said cylindrical housing, a stationary beater plate located externally of said cylindrical housing adjacent to said inlet opening, and a plurality of beater bars rotatably mounted within said cylindrical housing such that the axis of rotation thereof is offset relative to said central axis, said beater bars being capable of rotating past said inlet opening first towards said ribs and then towards said grate such that a fibrous product supplied to said inlet opening over said stationary beater bar will become defibrated within said cylindrical housing, said beater bars sweeping fibres off said curved surfaces of said parallel grate bars.

2. Defibrator as defined in claim 1, wherein the outlet opening has a width between 6 and 8 mm, wherein the distance between adjacent grate bars is between 1½ and 2 mm thereby only allowing single fibers to pass through the grate, and wherein each grate bar tapers in direction away from said outlet opening and each grate bar has a maximum width between ½ and 1 mm, a thickness between 8 and 12 mm, and a length between 80 and 120 mm.

3. A defibrator as defined in claim 1, including an outlet pipe connected to said cylindrical housing and in communication with said outlet opening, and including a suction fan in said outlet pipe.

4. A defibrator as defined in claim 1, wherein said ribs extend parallel to said axis of rotation.

5. A defibrator as defined in claim 1, wherein the ribs extend helically around the axis of rotation.

6. A defibrator as defined in claim 1, wherein the grate covering the outlet opening is arranged protruding above the inner wall of the cylindrical housing.

7. A defibrator as defined in claim 1, wherein a funnel is connected with the outlet opening, said funnel containing stirring means for distributing fibers evenly across a forming wire arranged immediately beneath said funnel.

8. A defibrator as defined in claim 1, wherein said cylindrical housing defines a length and wherein said outlet opening extends the length of said cylindrical housing.

9. A defibrator as defined in claim 1, wherein said outlet opening is located at a 270° angle around said cylindrical housing relative to said inlet opening.

10. The combination of a forming wire and a defibrator positioned above the forming wire to deposit fibers thereon, such defibrator comprising:

a cylindrical housing, which defines an inlet opening, an outlet opening, an inner surface, and a central axis, a plurality of ribs located on said inner surface of said cylindrical housing adjacent said inlet opening, said plurality of ribs each providing a curved surface facing inwardly of said cylindrical housing, a grate positioned across said outlet opening of said cylindrical housing, said grate being formed of parallel grate bars providing curved surfaces which face inwardly of said cylindrical housing, a stationary beater plate located externally of said cylindrical housing adjacent to said inlet opening, and a plurality of beater bars rotatably mounted within said cylindrical housing such that the axis of rotation thereof is offset relative to said central axis, said beater bars being capable of rotating past said inlet opening first towards said ribs and then towards said grate such that a fibrous product supplied to said inlet opening over said stationary beater bar will become defibrated within said cylindrical housing, said beater bars sweeping fibres off said curved surfaces of said parallel grate bars.

11. The combination as defined in claim 10, wherein said defibrator is positioned above said forming wire such that the outlet opening of said cylindrical housing is downwardly oriented.

12. The combination as defined in claim 10, including a plurality of said defibrators successively positioned above said forming wire.

* * * * *